US006412636B1

(12) United States Patent
Jones et al.

(10) Patent No.: US 6,412,636 B1
(45) Date of Patent: Jul. 2, 2002

(54) UNIT DOSE PACKAGING SYSTEM WITH CHILD RESISTANCE AND SENIOR FRIENDLY FEATURES

(75) Inventors: Brad A. Jones, Chesterfield; Meredith M. Karow, Midlothian, both of VA (US); Mohan Sasthav, Elkridge, MD (US)

(73) Assignee: Westvaco Corporation, Stamford, CT (US)

( * ) Notice: Subject to any disclaimer, the term of this patent is extended or adjusted under 35 U.S.C. 154(b) by 0 days.

(21) Appl. No.: 09/860,443

(22) Filed: May 21, 2001

(51) Int. Cl.[7] ..... B65D 83/04
(52) U.S. Cl. ..... 206/532; 206/539; 229/125.125
(58) Field of Search ..... 206/528–539; 220/345.1, 345.2; 229/125.12, 125.125

(56) References Cited

U.S. PATENT DOCUMENTS

| | | | | | |
|---|---|---|---|---|---|
| 3,332,600 | A | * | 7/1967 | Guernsey | 229/125.125 |
| 3,381,808 | A | * | 5/1968 | McGraw, II | 206/534 |
| 4,340,141 | A | | 7/1982 | Fischer | 206/531 |
| 5,275,291 | A | * | 1/1994 | Sledge | 206/531 |
| RE35,445 | E | | 2/1997 | Pora | 206/532 |
| 5,799,675 | A | | 9/1998 | Gunderman et al. | 132/333 |
| 5,954,202 | A | | 9/1999 | Mellon | 206/462 |
| 5,954,204 | A | | 9/1999 | Grabowski | 206/531 |
| 6,047,829 | A | | 4/2000 | Johnstone et al. | 206/531 |
| 6,082,544 | A | | 4/2000 | Romick | 206/531 |
| 6,230,893 | B1 | * | 5/2001 | Karow | 206/531 |
| 6,349,831 | B1 | * | 2/2002 | Buss | 206/531 |

* cited by examiner

*Primary Examiner*—Jim Foster

(57) ABSTRACT

A two-piece package for housing and dispensing a unit dose product. The product to be dispensed is contained on an internal slide card that is removably and lockably engaged within an outer sleeve. The package provides a child resistant and user-friendly dosing means that can be opened and closed numerous times while in use, then disposed of when all the unit doses are exhausted.

13 Claims, 10 Drawing Sheets

UNIT DOSE PACKAGING SYSTEM WITH CHILD RESISTANCE AND SENIOR FRIENDLY FEATURES

TECHNICAL FIELD AND INDUSTRIAL APPLICABILITY

The invention relates to a two piece paperboard package for containing unit dose materials, the unit doses being encapsulated on an internal slide card within an outer sleeve. The package includes features that render it suitable for packaging such unit doses while meeting regulatory criteria for child resistance by the inclusion of a pull-out mechanism comprised of offset notches for withdrawing the internal slide card from the outer sleeve, in combination with a false bottom that provides additional support to the outer sleeve, and tear resistant lamination of at least a portion of the sleeve.

BACKGROUND OF THE INVENTION

Unit dose packaging is an attractive packaging format for certain pharmaceutical applications because it is convenient, yet sturdy enough to be opened and closed numerous times until the course of medication is completed, and also enables the user to track the consumption of doses according to the prescribed schedule. Examples of such packaging are described in U.S. Pat. No. 6,047,829 (Johnstone), which is commonly assigned with the invention described herein. The Johnstone patent relates to a unit dose paperboard package that includes an outer paperboard sleeve, an inner paperboard slide card that is lockably retained within the sleeve. The sleeve includes a plurality of side panels operatively connected to each other such that one of said plurality of side panels includes a first inner slide card releasing means, and another of said side panels includes a second inner slide card releasing means, such that the inner slide card retaining and releasing means are located substantially adjacent to said unit dose dispensing means.

The invention described herein is an improvement over that described and claimed in U.S. Pat. No. 6,047,829, in that the package is rendered less susceptible to unintentional opening and has improved structural stability. Child resistance is a feature particularly desired for pharmaceutical packaging, and is mandated by the Poison Prevention Packaging Act of 1970. For a desired child resistance (CR) rating of F=1, a random sampling of the subject packages may not be compromised by an age specific test pool of children at a failure rate of greater than 10%. This general guideline is designed to ensure that the package has sufficient integrity against tampering by children. In view of this desired requirement, it is an object of the invention to provide a unit dose packaging system with improved child resistance, which prevents unauthorized access to the package contents.

In addition to child resistance, however, it is also desirable that the unit dose packaging system be senior friendly to permit easy withdrawal of the package contents with minimum manipulation. Such a withdrawal means should be easy to use even if the patient's manual dexterity or strength is reduced. Accordingly, another object of the present invention is to provide a senior friendly package that can be easily manipulated by the user.

These objectives are met by the packaging system, articles and methods of the present invention, which are described and claimed below.

SUMMARY OF THE INVENTION

The invention meets the needs for child resistance and senior friendliness by providing a unit dose paperboard package having a locking feature that permits the package to be opened and closed during repeat usage, then disposed of when all the unit doses have been consumed. The package comprises an outer sleeve, which may be at least partially laminated to provide tear resistance, said sleeve further comprising an internal structural support formed from a panel extension thereof; and an internal slide card.

In one aspect, therefore, the invention comprises:

a) an outer sleeve including a plurality of side panels, a plurality of hinge panels, said side panels and hinge panels being operatively connected to each other; and wherein at least one side panel includes a foldable extension thereof, said extension being folded toward the interior of the sleeve to form a false bottom; and further wherein one of the side panels includes an internal slide card retaining element and a first inner slide card releasing element, and another of said plurality of side panels includes a second inner slide card releasing element; wherein the outer sleeve includes a pair of offset notches for grasping and removing an internal slide card; and wherein the outer sleeve is at least partially laminated with a polymeric film material; and b) an internal slide card having encapsulated therein one or more blisters each containing a unit dose of a material to be dispensed, the slide card being comprised of a slide card body and an extension, the extension being folded inwardly over and being positioned parallel to the slide card body when the package is closed.

In another aspect, the invention comprises a blank for forming a lockable outer sleeve for housing an internal slide card of a unit dose package comprising a plurality of side panels and a plurality of hinge panels; at least one of said side panels comprising an extension thereof forming an internal slide card retaining element, and at least one side panel thereof additionally comprising a first internal slide card releasing element; and at least another side panel comprising a second internal slide card releasing element; and further comprising, in combination, a pair of notches, each notch being formed along an outer edge of the sleeve in an offset parallel relationship to the other, and a false bottom formed by a foldable extension of at least one side panel.

In yet another aspect of the invention, there is disclosed a method of packaging unit doses of a periodically dispensable material comprising:

a) cutting a blank for forming an outer sleeve from a substrate material;

b) forming an internal slide card from a substrate material, said internal slide card including a body and a foldable extension thereof;

c) folding the blank to form an outer sleeve including a plurality of side panels, the side panels having included therein at least one slide retaining means and at least one slide releasing means, at least one side panel comprising a foldable extension thereof which, when folded, forms a false bottom within the interior of the sleeve; the blank further including a pair of notches positioned in an offset parallel relationship to each other when the blank is folded;

d) encapsulating unit doses of a material onto the internal slide card;

e) folding the extension of the slide card to position the extension parallel to the body of the slide card;

f) inserting the folded slide card into the sleeve such that the extension thereof becomes slidably and lockably engaged with the slide retaining means in the side panels of the sleeve.

A unit dose package according to the invention is thus composed of an internal slide card and an outer sleeve. The outer sleeve or the internal slide card may be cut from any suitable material, for example plastic, paperboard or, if desired a laminate of paperboard and another foldable material, for example a foil or a polymeric film. Suitable paperboard materials are described, for example, in U.S. Pat. No. 6,047,829, the entire disclosure of which is herein incorporated by reference. The selection of this substrate may be made according to the packaging need, and accordingly, a substrate material generally recognized as safe (GRAS) by the FDA is also within the scope of the invention. In certain preferred embodiments, the substrate may be selected from a sheet of bleached sulfate board, solid unbleached sulfate board (SUS), clay-coated newsback (CCNB), or any other suitable board substrate, such a substrate preferably ranging in thickness from about 0.008 inches up to about 0.050 inches. For example, the paperboard may be clay coated on one side (C1S) or on both sides (C2S), with a coating such as a fluidized blend of mineral pigments selected from coating clay, calcium carbonate and/or titanium dioxide with starch or adhesive, or various combinations of these materials. Successive densification and polishing (via calendering) finishes each coated surface to a to high degree of smoothness and renders it suitable for graphics printing of superior quality.

The sleeve includes a plurality of side panels forming the wider surfaces of the package, these side panels being operatively connected by a plurality of hinge panels. Preferably at least one of the plurality of side panels includes an internal slide card retaining element and a first internal slide card releasing element, while another of the plurality of side panels includes a second internal slide card releasing element. In certain preferred embodiments, the internal slide card retaining elements are extension panels. The first internal slide card releasing element is preferably composed of a cut away region that includes a node for engaging an extension of the slide card in at least one side panel, while the second internal slide card releasing means is preferably in the form of a release button located in yet another of the plurality of side panels.

The present invention comprises various improvements to the sleeve element that contribute to the package stability. In one such modification, the sleeve blank may be cut to include an extension which, when folded inward, creates a false bottom in the lower end of the package. This false bottom, which is positioned beneath the release button located on the exterior of the paperboard sleeve, provides structural support to the package and causes the sleeve to be more resistant to deformation by squeezing or crushing. This feature is useful because such deformation can allow the release mechanism to be depressed and the locking mechanism of the package disengaged, thereby providing inadvertent access to the package contents. The inclusion of the false bottom also allows the release button to be located more towards the center of the package without also changing the dimensions of the internal slide card. This placement makes access to the release mechanism more difficult for a child.

Alternatively, areas of the sleeve that are susceptible to tearing may be formed from a double thickness of the substrate material. This feature reduces the possibility that the package may be torn open and also increases the overall sturdiness of the package exterior. To achieve this doubled thickness, the blank for forming the sleeve may be cut to include one or more panel extensions which can then be folded to lay parallel and adjacent to one or both side panels of the package. In one preferred embodiment, the panel extensions are formed at the side panels to provide a doubled thickness at the sleeve edges.

Depending on the choice of substrate material, another means of improving the impenetrability of the sleeve involves lamination of at least a part of one or both sides of the blank with a polymer film. In this manner, the exterior of the package is made more resistant to tearing. Optionally, this lamination may not extend over the entire surface of the sleeve blank. For example, only tear prone regions may require lamination. Suitable laminating materials may, for example, be selected from biaxially oriented or cross-laminated polymeric films such as high density polyethylene (HDPE), polyolefins, polyesters, e.g. Mylar™, or combinations thereof. In a related embodiment, tear resistance may be provided at stress points such as the package corners and exposed edges by applying one or more strips of the polymeric film, e.g. as a tape, over these areas. In either aspect, the polymeric film may be applied by extrusion or adhesive lamination, or by any other suitable means known in the art, typically to the side that is the interior surface of the blank. It has been found that this treatment significantly increases tear resistance and prevents tear propagation in the outer sleeve. Preferably, neither the complete laminate film nor the selectively applied film strips will detract from the package's aesthetic appearance or interfere with printability or any of the other desirable display features. Text or graphic information may be printed on the sleeve or on the surfaces of the internal slide card according to any means conventionally known in the art.

Another feature that suitably contributes to the child resistance of the package according to the invention is the positioning of the cut-aways or notches for withdrawing the slide card from the interior of the sleeve. The package disclosed in U.S. Pat. No. 6,047,829 included notches that were symmetrically placed on corresponding edges of the side panels to form a cut out. According to the present invention, the placement of the notches is altered such that each notch on one side panel is offset from the other, with only a small area of overlap forming a cut out area exposing the edge of the internal slide card. To open the package, the user must therefore grasp the slide card through the offset notches. Because this step requires asymmetric placement of the fingers, which is counter-instinctive to children, their ability to grasp and withdraw the slide card is greatly reduced.

In other preferred embodiments of the invention, the outer sleeve of the package provides additional protection for the internal slide card, which houses the unit dose product being used. The internal slide card has a stop feature, typically a folded extension thereof, that engages with a catch feature, typically also a folded extension, on the outer sleeve, to prevent the user from pulling the internal slide card completely away from the outer sleeve.

Optionally, other means for improving the structural integrity of the overall package may be incorporated. Such features include lamination of the slide card with a polymeric film, as described above, which also improves tear resistance.

DETAILED DESCRIPTION OF THE PREFERRED EMBODIMENTS OF THE INVENTION

According to the present invention, there is provided an improved unit dose packaging system comprising certain structural features that improve and/or enhance the child resistance and senior friendliness of the packaging.

Figure 1:
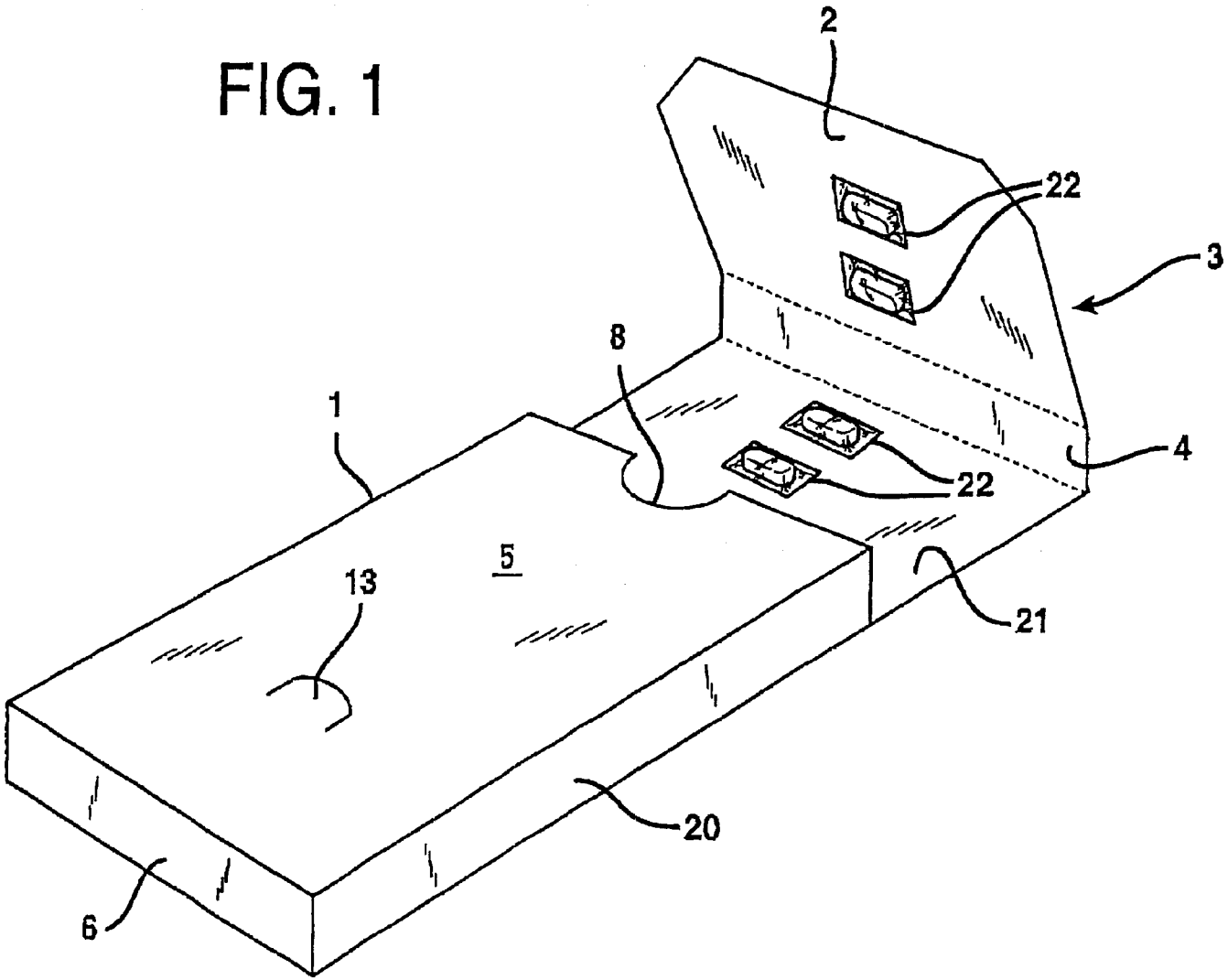
FIG. 1 is an isometric view of an opened package according to the invention including an internal slide card and outer sleeve with button release means.
Figure 2:
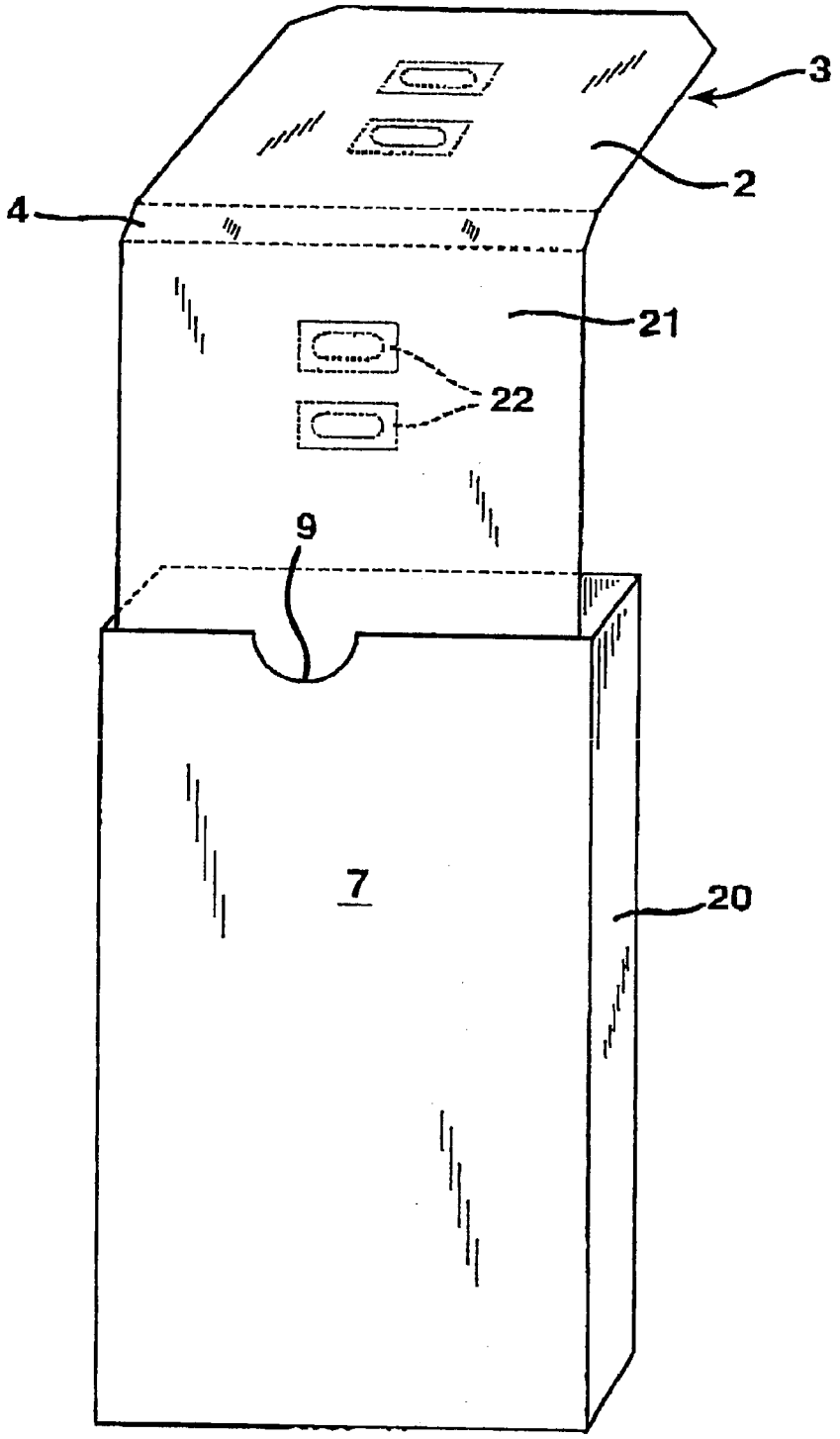
FIG. 2 is an isometric rear view of the package.

As represented in the accompanying figures, a preferred embodiment of the unit dose package of the invention comprises a slide card 3, which is releasably, lockably engaged with an outer sleeve 1. The package contents are contained in unit dose form on blisters 22 located on slide card 3. The sleeve 1 is composed of side panels 5 and 7, which are foldably connected by hinge panels 20, and a bottom panel 6, which secures one end opening of the package. As shown in FIG. 1, the side panel 5 comprises a release button 13, which is formed by a series of connected cuts in the substrate made by conventional techniques. The cut edges form a flexible tab that can be depressed to exert pressure on one or more layers of substrate underlying side panel 5. Side panel 5 also includes a notch 8 that provides a finger hold for withdrawal of the slide card 3. As represented in FIG. 2, a corresponding notch 9 having similar dimensions as notch 8 is positioned parallel to but offset from notch 8 in the edge of side panel 7. In the embodiment represented by FIGS. 1 and 2, the notch 8 is positioned close to the center of the edge of side panel 5, while notch 9 is positioned off center such that there is incomplete overlap with notch 8. The position of these notches along the outer edges of the sleeve and their placement in relation to each other may be varied depending on the overall dimensions of the package.

Figure 3:
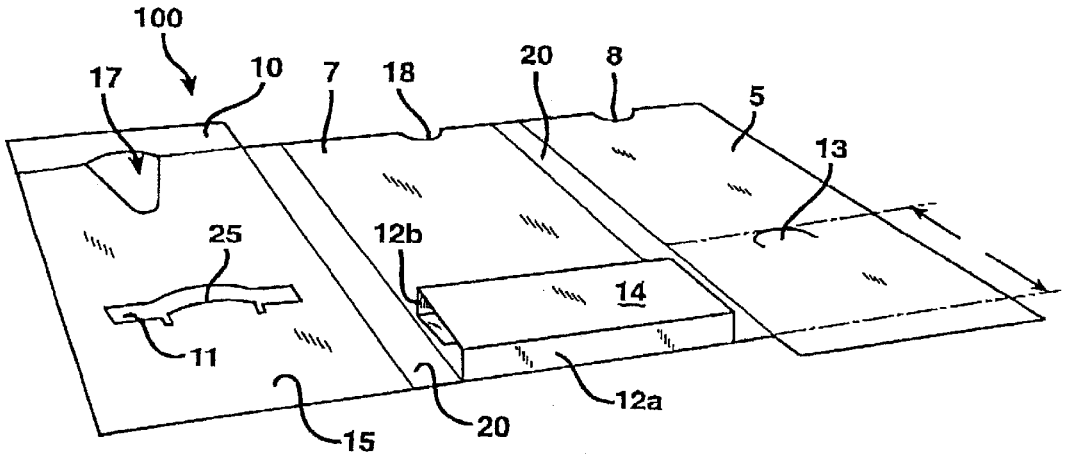
FIG. 3 is an isometric view of a partially folded blank for forming the outer sleeve of the package, according to one embodiment of the invention.
Figure 4:
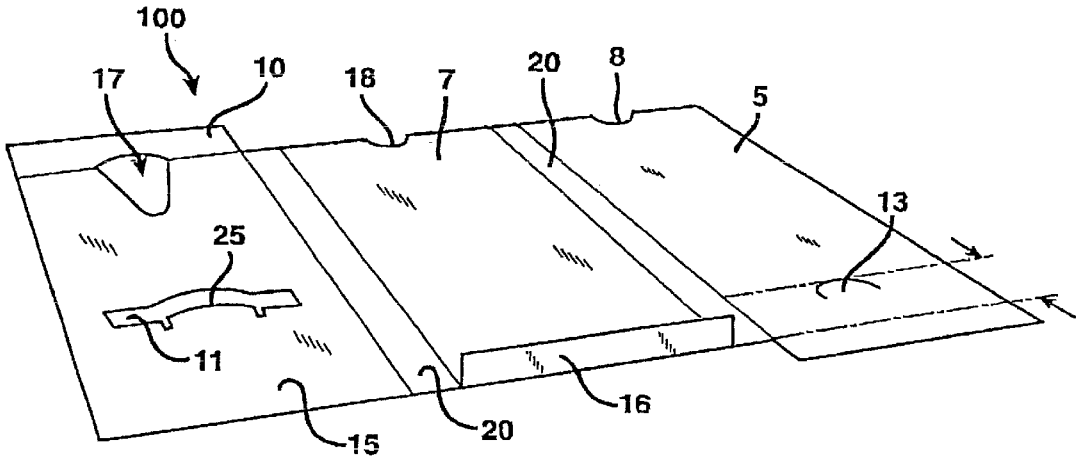
FIG. 4 PRIOR ART
FIG. 4 is partially folded sleeve for the prior art unit dose package system, as described in U.S. Pat. No. 6,047,829.

As shown in FIG. 3, the sleeve 1 is formed from a blank 100 that is scored to form three panels 5, 7 and 15. To form the sleeve, panel 15 is folded beneath and secured, for example using an adhesive, beneath panel 5, such that panel 15 is positioned within the interior of the formed sleeve 1. The panel 15 includes a panel extension 10, which acts as a stopping device that prevents the internal slide card 3 from being pulled completely out of the sleeve 1. In the preferred embodiment of FIG. 3, panel 7 includes an additional extension 14, which may be folded toward the center of panel 7 to form structural panels 12*a* and 12*b*, each being of dimensions identical to those of end panel 6, and a structural panel 14 which underlies panels 5 and 15 in the folded sleeve 1. In comparison to the prior art, as represented by FIG. 4, the sleeve of the present invention includes improvements in the form of structural panels 12*a*, 12*b* and 14, which reduce deformation of the side panels to release the locking mechanism, as may be achieved when the sides of the package are squeezed. These structural panels, in effect, form a false bottom that strengthens the package and thus renders it more tamper resistant. Panel 15 additionally includes a cut away area 11 having a node 25. The cut away area 11, node 25, release button 13, and extension panel 10 together form the locking assembly for the package of the invention. The locking mechanism operates similarly to that described in U.S. Pat. No. 6,047,829, previously herein incorporated by reference. The embodiment of FIG. 3 also includes cutaway areas 17 and 8, which, when folded together, form a notch that is paired with offset notch 18. Alternatively, a notch 9 may be formed from a folded extension 19 of one side panel 7, as is shown in FIGS. 6 and 7.

Figure 5:
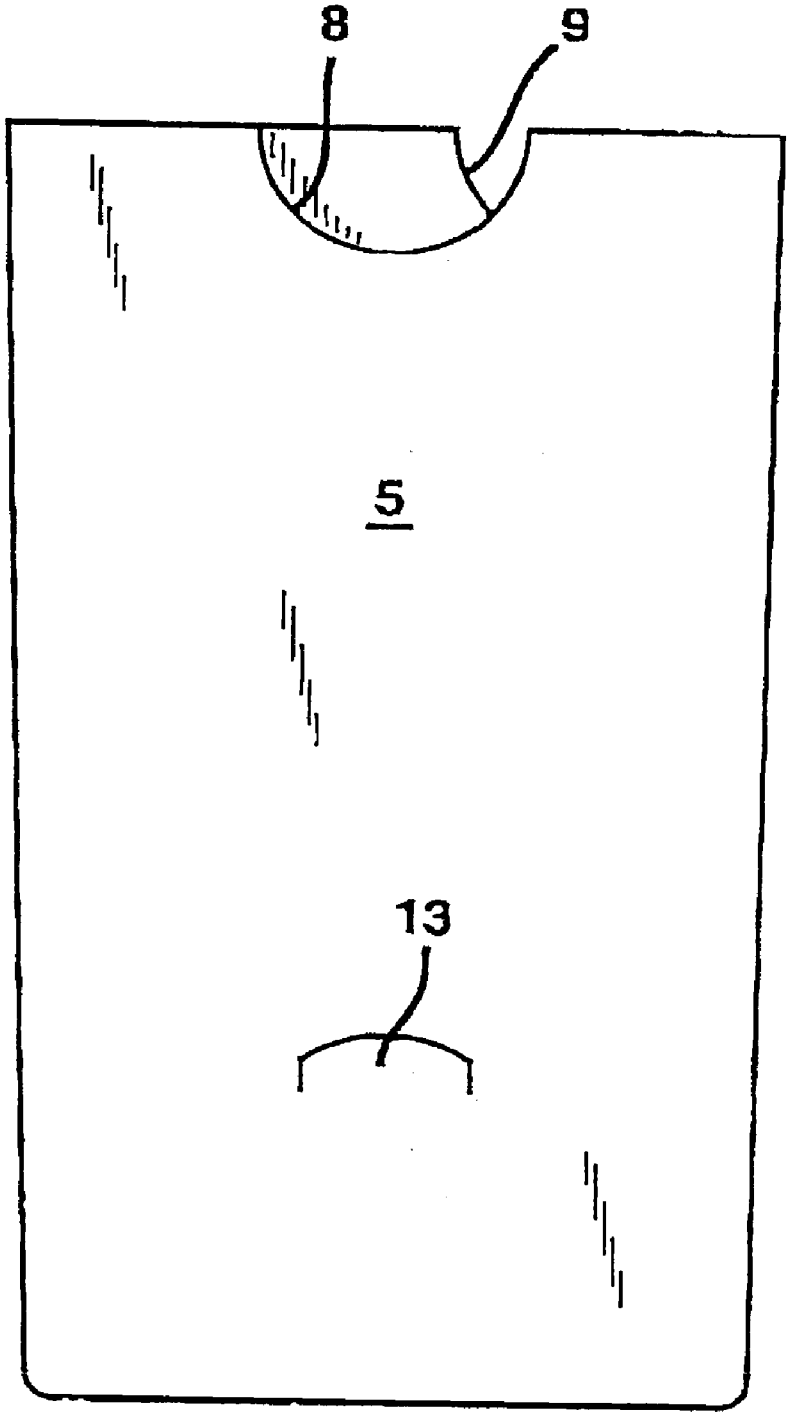
FIG. 5 is a two-dimensional representation of the sleeve side panels, as folded when the package of the invention is formed, showing the offset notches.

FIG. 5 demonstrates the offset notches, which provide an additional tamper resistance feature. The notches are cut in the edges of sleeve panels 5 and 7 such that there is a degree of overlap between the notches. In this manner, the user's fingers may be positioned in an offset manner to withdraw the internal slide card. Because this positioning is counter-instinctive, however, the placement of the notches heightens resistance of the package to tampering by children.

Figure 6:
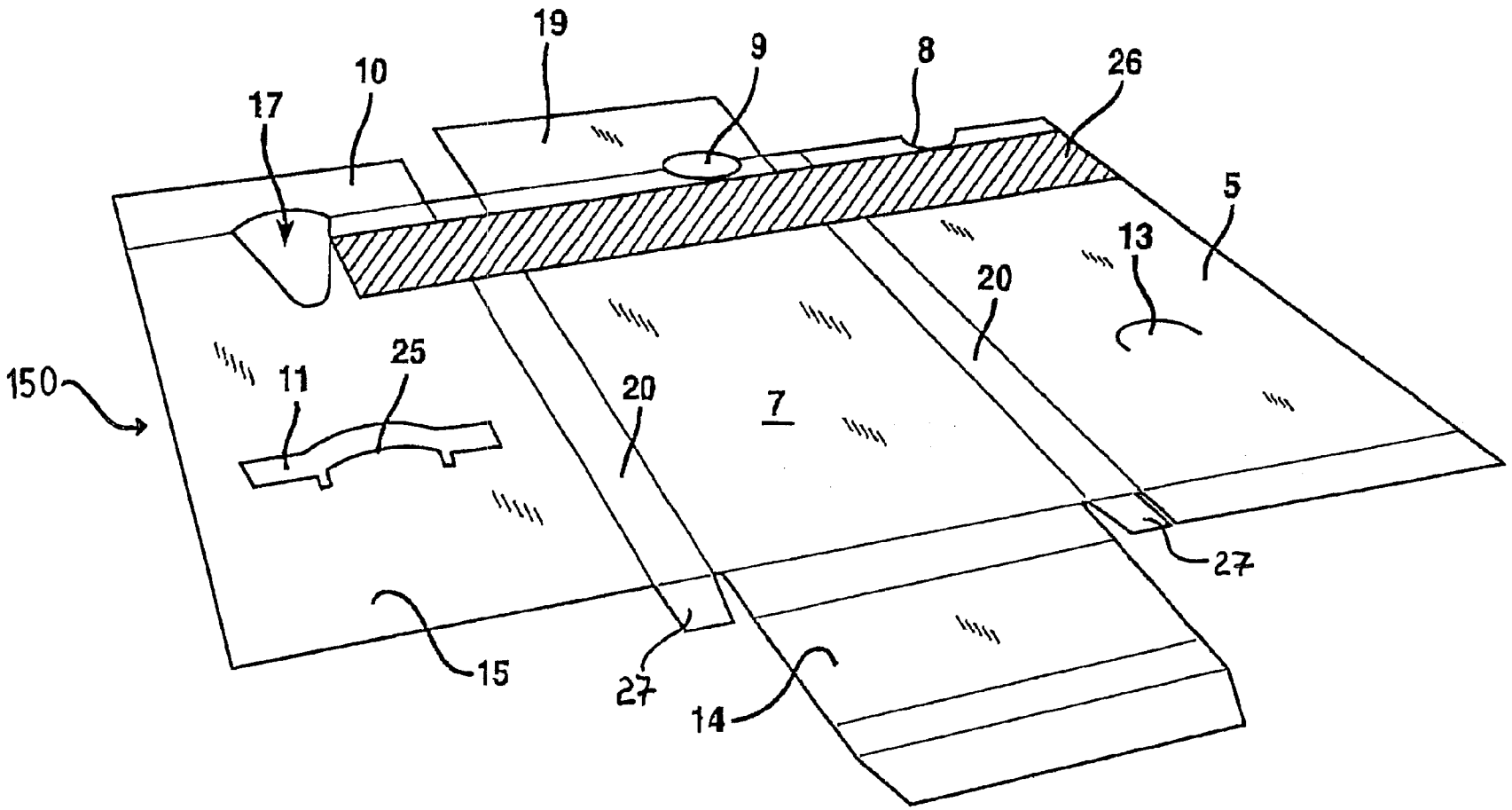
FIGS. 6 and 7 are plan drawings depicting various embodiments of the sleeve according to the invention.
Figure 7:
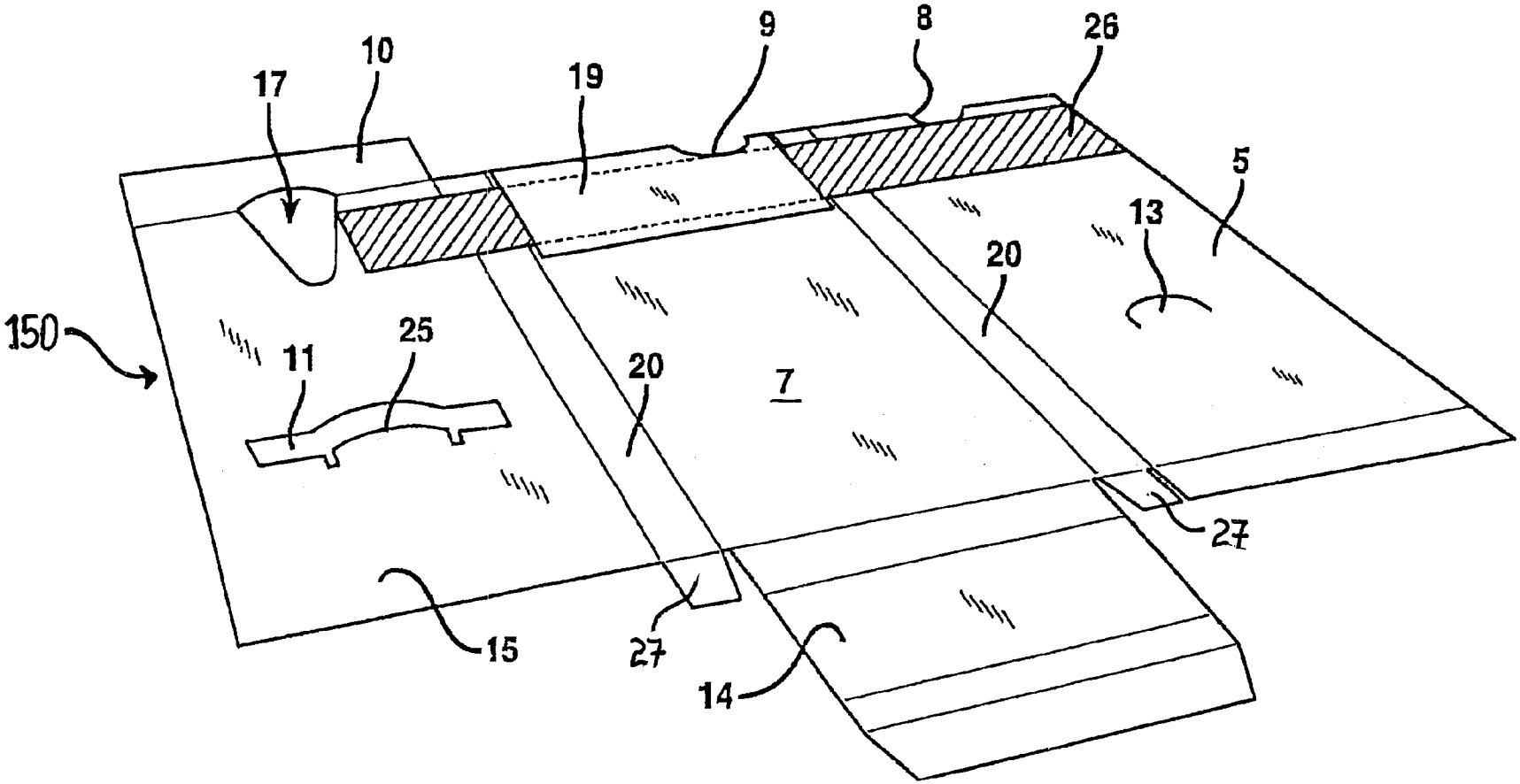

FIGS. 6 and 7 depict a blank 150 for forming the outer sleeve 1. The tri-panel construction includes side panels 5 and 7, as well as support panel 15, which folds beneath side panel 5. Minor flaps 27, which may optionally be included, provide additional structural support to the package edges. Panel 15 includes a cut away area 11 including node 25, the cut away being designed to fit between the panel 15 and folded extension 10, thereby providing a retention means that stops the complete removal of the internal slide card 3 from the sleeve. As an additional structural reinforcement feature, the blank 150 includes an extension 19, which, when folded toward the interior of the sleeve, provides additional structural enhancement of the sleeve to make it less susceptible to tearing. The panel 7 and extension 19 are cut with reciprocal circular or arcilinear cuts that form notch 9 when the extension 19 is folded. The embodiment represented by FIGS. 6 and 7 also includes a plastic film strip 26, which is adhered along the edges of panels 5, 7 and 15. The film strip 26 acts as a reinforcement of the edges of the outer sleeve 1 to prevent tear propagation. The edges of tape strip 26 may be positioned flush with the edges of side panels 5, 7, 15 and hinge panels 20, or it may be positioned behind the edges toward the interior of the blank 150. The tape strip 26 may be applied before or after the sleeve blank is cut. In a preferred embodiment, for example, the tape may be applied to a substrate material before it is die cut into blanks. Preferably, tape strip 26 does not extend across the entire width of panel 15 in order to prevent engagement of the internal slide card extension 24 with the strip 26 as it is being withdrawn and reinserted into the sleeve 1. In other embodiments, one or both surfaces of the blank 150 may be completely laminated with a polymeric film instead of being partially laminated with the film strip 26. Preferably, this lamination is performed before the substrate material for forming the sleeve blank is die cut.

Figure 8:
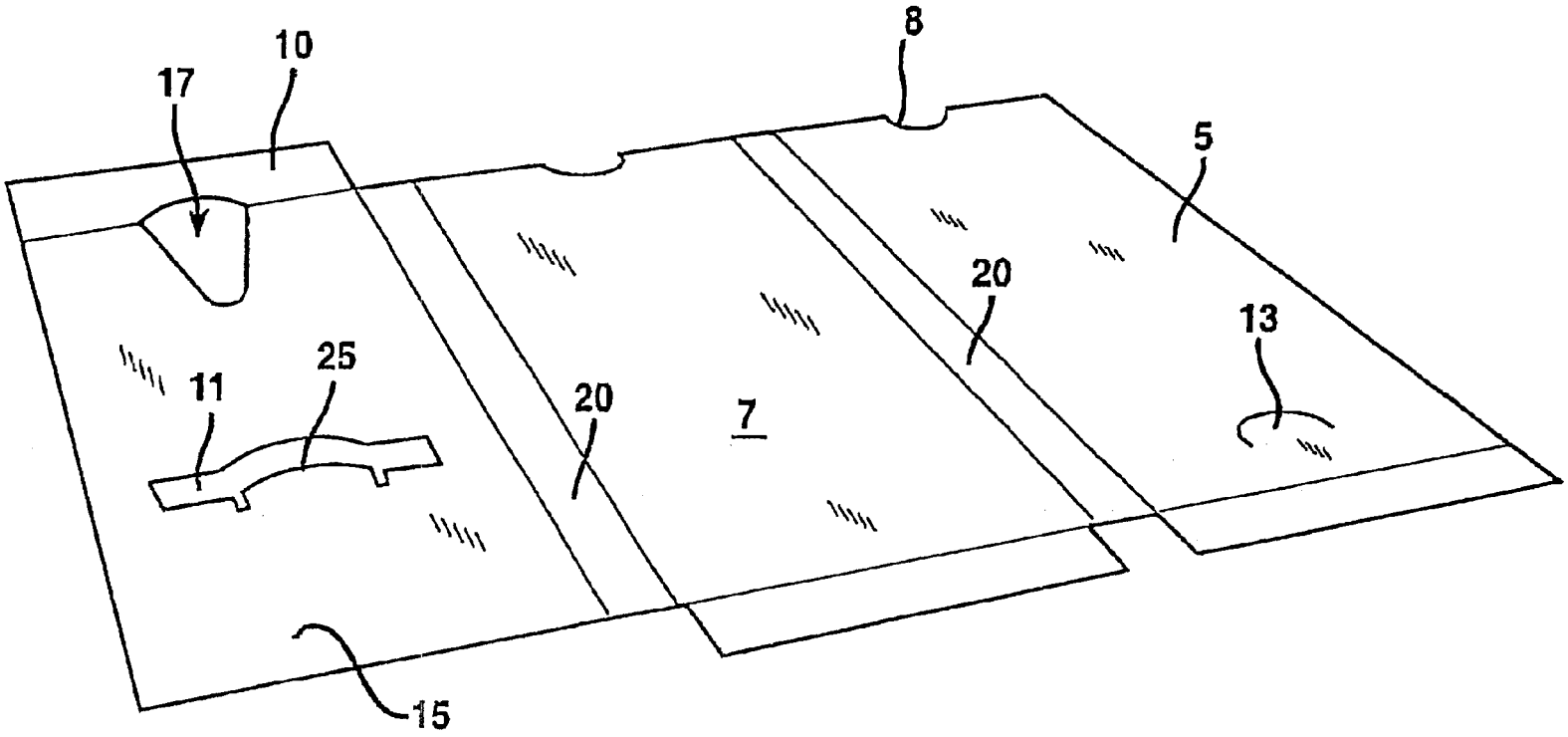
FIG. 8 PRIOR ART
FIG. 8 is a plan drawing of the sleeve used in the prior art unit dose packaging system, as described in U.S. Pat. No. 6,047,829.

FIG. 8 represents a blank for forming a sleeve according to the invention of U.S. Pat. No. 6,047,829.

Figure 9:
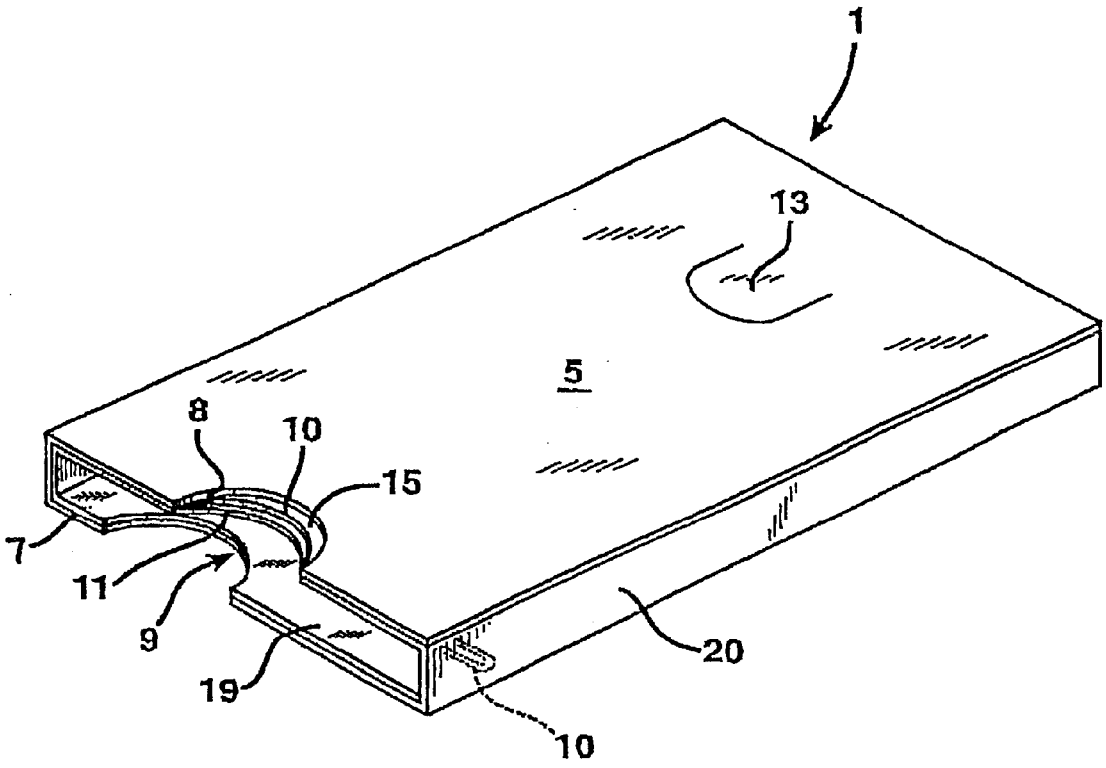
FIG. 9 is an isometric view of the outer sleeve of the package of the invention showing the offset notches for removal of the internal slide card and doubled thickness of substrate material in the region of the notches.

FIG. 9 is an isometric view of the folded outer sleeve 1 showing offset placement of the notches 8 and 9, as well as the doubled thickness formed by folded extensions 10 and 19 around the open edges.

Figure 10:
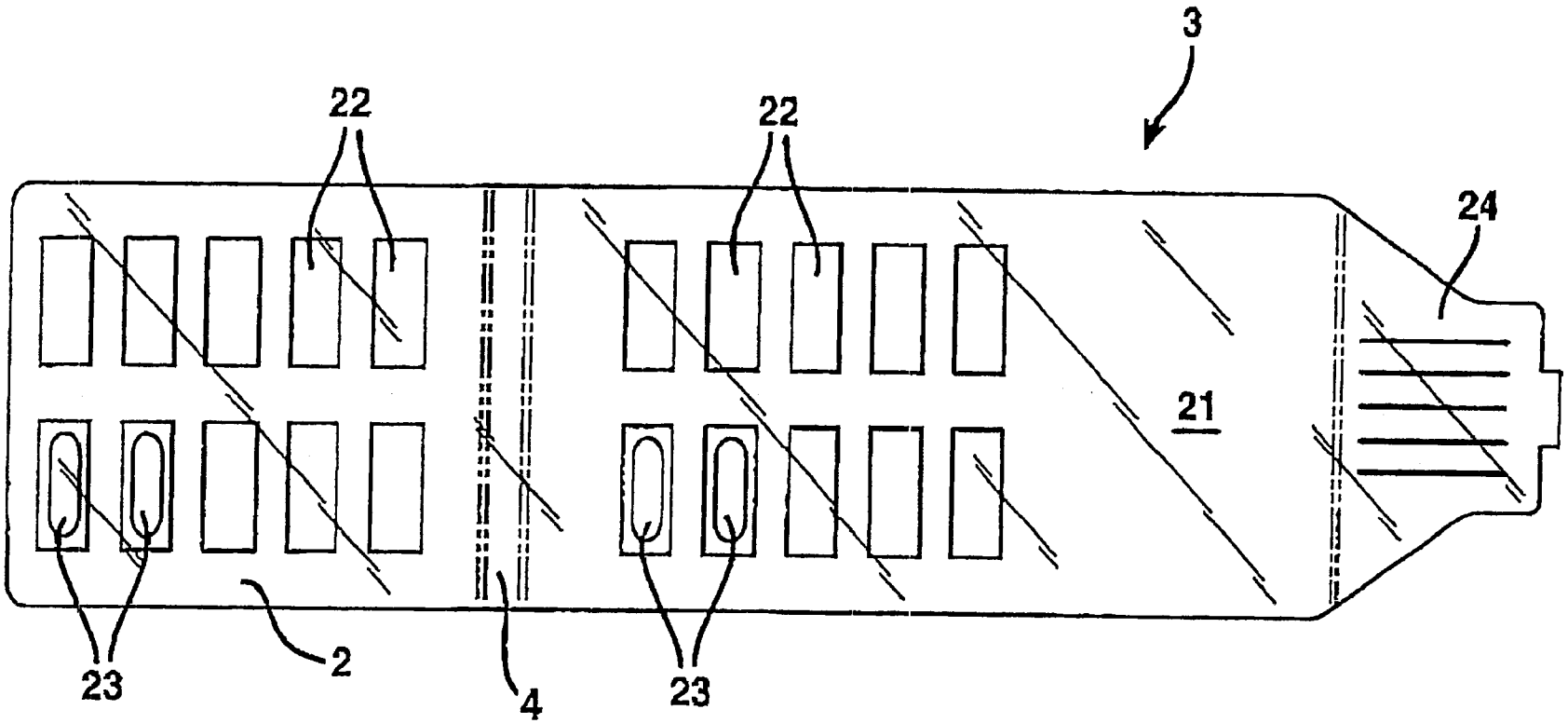
FIG. 10 is a planar representation of the foldable internal slide card used in the package of the present invention.
Figure 11:
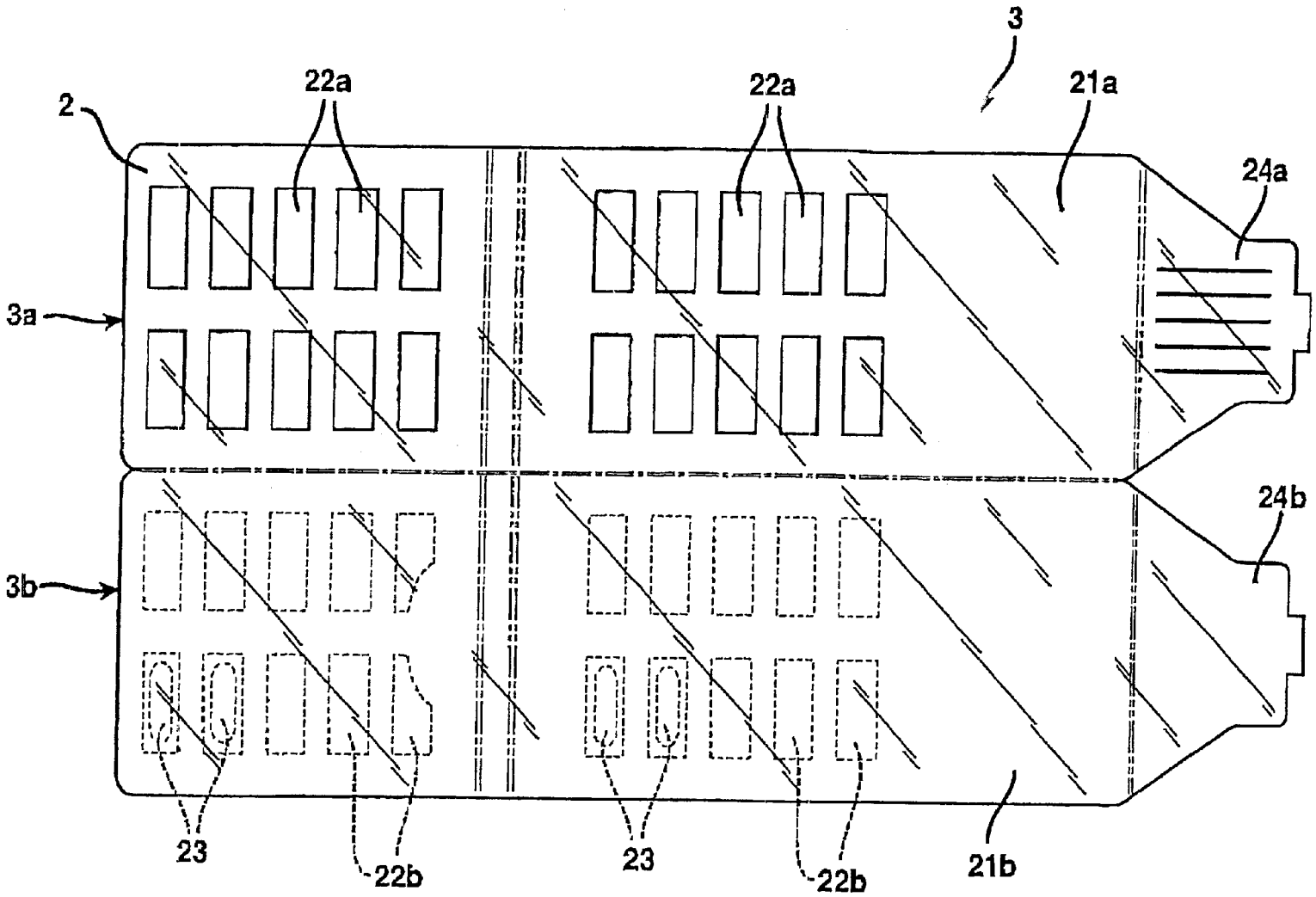
FIG. 11 is a planar representation of a blank for forming the internal slide card according to a preferred embodiment of the invention.

FIGS. 10 and 11 provide planar views of the internal slide card 3 and the blank therefor, respectively. Slide card 3 is composed of the slide card body 21, and a slide card extension 2. The extension 2 is inserted into the package when it is closed. This folding feature allows a longer slide card, which is capable of holding a larger number of unit doses, to be incorporated into the package. Additionally, the folded slide card provides additional structural support within the sleeve. Fold lines scored in the panel 3 form fold panel 4, which conforms to the internal dimensions of the package and is approximately symmetrical to end panel 6. As shown in FIG. 10, two symmetrical sections 3*a* and 3*b* fold together and may be glued or otherwise adhered together to form the internal slide card 3. Slide card body 21 and extension 2 include perforated areas 22*a* and dose holes 22*b*, which together form blisters 22 for containing unit doses 23. The slide card 3 also includes a notch-shaped foldable extension 24, formed from adhered sections 24*a* and 24*b*. The extension 24 is an element of the locking mechanism of the package.

When the package is formed, the slide card 3 is inserted between panels 5 and 7 and pushed inward such that the edge of folded extension 24 springs upward and becomes biased against node 25. This engagement with node 25 prevents the slide card 3 from being removed unless release button 13 is depressed to allow depression of panel 15. By this means, the extension 24 is disengaged from the node 25, and the depression of the panel 15 prevents re-engagement. The slide card 3 may then be withdrawn from the sleeve until the extension 24 becomes engaged within the fold formed by extension 10 and panel 15. The locking and release mechanism is further described in U.S. Pat. No. 6,047,829.

The package of the present invention offers advantages in that it is lightweight, tamper resistant, senior friendly, durable, easy to assemble, offers protection of each unit dose until it is consumed, and is economical. Moreover, the invention provides a child resistant yet user-friendly unit dose packaging container, which may be used to contain and dispense a variety of contents. The improved tamper resistant features of the package may be attributed, at least in part, to the presence of the false bottom structural support, the offset notch placement and the use of partially or fully laminated structural materials in construction of the package sleeve and slide card. Suitably, the package may, for example, be used to store pharmaceuticals preparations requiring repeat periodic dosage regimens. As used herein, the term "pharmaceutical preparation" is intended to include prescribed or over the counter drugs or supplements, vitamins or other medicaments, or any other materials suitable for containment in a package of foil/paperboard or plastic construction.

It is believed that the present invention includes many other embodiments that may not be herein described in detail, but would nonetheless be appreciated by those skilled in the art from the disclosures made. Accordingly, this disclosure should not be read as being limited only to the foregoing examples or only to the designated preferred embodiments.

We claim:

1. A unit dose paperboard package having improved child resistance characteristics comprised of:

a) an outer sleeve including a plurality of side panels, a plurality of hinge panels, said side panels and hinge panels being operatively connected to each other; and wherein at least one side panel includes a foldable extension thereof, said extension being folded toward the interior of the sleeve to form a false bottom; and further wherein one of the side panels includes an internal slide card retaining element and a first inner slide card releasing element, and another of said plurality of side panels includes a second inner slide card releasing element;

wherein the outer sleeve includes a pair of offset notches for grasping and removing an internal slide card;

wherein the outer sleeve is at least partially laminated with a polymeric film material; and b) an internal slide card having encapsulated therein one or more blisters each containing a unit dose of a material to be dispensed, the slide card being comprised of a slide card body and an extension, the extension being folded inwardly over and being positioned parallel to the slide card body when the package is closed.

2. The package of claim 1, wherein the polymeric film material is in the form of a tape strip around one or more edges of the outer sleeve.

3. The package of claim 1, wherein the polymeric film material is laminated over an entire surface of the outer sleeve.

4. The package of claim 1, wherein the outer sleeve is constructed from a paperboard or plastic substrate.

5. A method of packaging unit dose materials comprising:

a) cutting a blank for forming an outer sleeve from a substrate material;

b) forming an internal slide card from a substrate material, said internal slide card including a body and a foldable extension thereof;

c) folding the blank to form an outer sleeve including top and bottom panels and side panels, the side panels having included therein at least one slide retaining element and at least one slide releasing element, at least one side panel thereof comprising a foldable extension which, when folded, forms a false bottom within the interior of the sleeve; the blank further including a pair of notches positioned in an offset parallel relationship to each other when the blank is folded;

d) encapsulating unit doses of a material onto the internal slide card;

e) folding the extension of the internal slide card to position it parallel to the body of the slide card;

f) inserting the folded internal slide card into the sleeve such that the extension thereof becomes slidably and lockably engaged with the slide retaining element in the side panels of the sleeve.

6. The method of claim 5, further including laminating at least a portion of the outer sleeve with a polymeric film material.

7. The method of claim 5, wherein the unit dose material is a pharmaceutical.

8. A blank for forming a lockable outer sleeve for housing an internal slide card of a unit dose package comprising a plurality of side panels and a plurality of hinge panels; at least one of said side panels comprising an extension thereof forming an internal slide card retaining element, and at least one side panel thereof additionally comprising a first internal slide card releasing element; and at least another side panel comprising a second internal slide card releasing element;

and further comprising, in combination, a pair of notches, each notch being formed along an outer edge of the sleeve in an offset parallel relationship to the other, and a false bottom formed by a foldable extension of at least one side panel.

9. The blank of claim 8 wherein the internal slide card retaining element is formed from an extension of one or more side panels.

10. The blank of claim 8, wherein the first internal slide card releasing element is in the form of a release button located in one side panel.

11. The blank of claim 8, wherein the second internal slide card releasing element is in the form of a cutaway located in one side panel.

12. The blank of claim 11, wherein the cutaway additionally includes a node for engagement of an edge of the internal slide card.

13. The blank of claim 9 further including a polymeric film material laminated over at least a portion of one or both surfaces thereof.

* * * * *